US005800697A

United States Patent [19]

Lengemann

[11] Patent Number: 5,800,697

[45] Date of Patent: Sep. 1, 1998

[54] FCC PROCESS WITH DUAL FUNCTION CATALYST COOLING

[75] Inventor: Robert A. Lengemann, Arlington Heights, Ill.

[73] Assignee: UOP LLC, Des Plaines, Ill.

[21] Appl. No.: 491,768

[22] Filed: Jun. 19, 1995

[51] Int. Cl.[6] ..... C10G 11/00

[52] U.S. Cl. ..... 208/159; 208/113; 208/120; 208/160; 585/910; 502/40; 502/44

[58] Field of Search ..... 208/159, 160, 208/113, 120; 585/910; 502/40, 44

[56] References Cited

U.S. PATENT DOCUMENTS

| | | | |
|---|---|---|---|
| 2,518,693 | 8/1950 | Jahnig | 502/44 |
| 2,684,931 | 7/1954 | Berg | 502/44 |
| 2,819,951 | 1/1958 | Medlin et al. | 208/160 |
| 3,351,548 | 11/1967 | Payne et al. | 208/160 |
| 3,392,110 | 7/1968 | Payne | 208/160 |
| 4,064,039 | 12/1977 | Penick | 208/160 |
| 4,272,402 | 6/1981 | Mayes | 502/40 |
| 4,374,750 | 2/1983 | Vickers et al. | 252/417 |
| 4,396,531 | 8/1983 | Lomas | 252/417 |
| 4,397,738 | 8/1983 | Kemp | 208/161 |
| 4,495,063 | 1/1985 | Walters et al. | 208/113 |
| 4,605,636 | 8/1986 | Walters et al. | 208/113 |
| 4,698,212 | 10/1987 | Waters et al. | 208/160 |
| 4,757,039 | 7/1988 | Lomas | 208/164 |
| 4,820,404 | 4/1989 | Owen | 208/159 |
| 4,822,761 | 4/1989 | Walters et al. | 208/113 |
| 4,840,928 | 6/1989 | Harandi et al. | 208/160 |
| 4,923,834 | 5/1990 | Lomas | 502/44 |
| 4,960,503 | 10/1990 | Haun et al. | 208/85 |
| 4,989,669 | 2/1991 | Barnes | 502/44 |
| 5,017,343 | 5/1991 | Cetinkaya | 422/140 |
| 5,027,893 | 7/1991 | Cetinkaya et al. | 502/44 |
| 5,212,129 | 5/1993 | Lomas | 502/44 |
| 5,286,690 | 2/1994 | Hoffmann et al. | 208/113 |
| 5,343,939 | 9/1994 | Cetinkaya et al. | 502/44 |

*Primary Examiner*—Walter D. Griffin
*Attorney, Agent, or Firm*—Thomas K. McBride; John G. Tolomei

[57] ABSTRACT

An FCC reactor and regenerator arrangement provides substantially independent control of temperature on the reactor side and regenerator side of the process. The arrangement withdraws cooled regenerated catalyst for transfer to a reactor riser and cooled regenerator catalyst for return to the regeneration zone. The process may operate with a single cooler that supplies catalyst to both the reaction side of the process and the regeneration side of the process.

5 Claims, 3 Drawing Sheets

FCC PROCESS WITH DUAL FUNCTION CATALYST COOLING

BACKGROUND OF THE INVENTION

1. Field of the Invention

This invention relates to the fluidized catalytic cracking (FCC) conversion of heavy hydrocarbons into lighter hydrocarbons with a fluidized stream of catalyst particles and regeneration of the catalyst particles to remove coke which acts to deactivate the catalyst. More specifically, this invention relates to the simultaneous control of regenerator and reactor temperatures using catalyst coolers.

2. Description of the Prior Art

Catalytic cracking is accomplished by contacting hydrocarbons in a reaction zone with a catalyst composed of finely divided particulate material. The reaction in catalytic cracking, as opposed to hydrocracking, is carried out in the absence of added hydrogen or the consumption of hydrogen. As the cracking reaction proceeds, substantial amounts of coke are deposited on the catalyst. A high temperature regeneration within a regeneration zone operation burns coke from the catalyst. Coke-containing catalyst, referred to herein as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones, and combusting coke in the regenerator are well known by those skilled in the art of FCC processes. To this end, the art is replete with vessel configurations for contacting catalyst particles with feed and regeneration gas, respectively. Despite the long existence of the FCC process, techniques are continually sought for improving the reactor and regenerator operation with the aim of increasing product recovery, both in terms of product quantity and composition, i.e. yield and selectivity while avoiding excessive equipment cost operational complexity and/or catalyst loss.

Much attention has focused on the initial contacting of the FCC feed with the regenerated catalyst to improve yield and selectivity of hydrocarbon products from the FCC unit. A variety of devices and piping arrangements have been employed to initially contact catalyst with feed. U.S. Pat. No. 5,017,343 is representative of devices that attempt to improve feed and catalyst contacting by maximizing feed dispersion. Another approach to improved feed and catalyst contacting is to increase the penetration of the feed into a flowing stream of catalyst. U.S. Pat. No. 4,960,503 exemplifies this approach where a plurality of nozzles rings an FCC riser to shoot feed into a moving catalyst stream from a multiplicity of discharge points. While these methods do improve feed distribution of the feed into the hot regenerated catalyst stream, there is still a transitory period of poor distribution when the relatively small quantities of the hydrocarbon feed disproportionately contact large quantities of hot catalyst. This poor thermal distribution results in non-selective cracking and the production of low value products such as dry gas.

One approach to feed and catalyst contacting that reduces local temperature maldistribution when mixing hot catalyst with the feed is shown in U.S. Pat. No. 4,960,503 which teaches indirect heating of the feed with the hot catalyst before contacting the feed with the regenerated catalyst in a reaction zone. By raising the temperature of the feed, less feed heating is required as the catalyst and feed are combined. Unfortunately, heating of the feed by indirect heat exchange with the catalyst can cause coking in the heat exchange equipment and, where heat is imported in to the system, can add heat to the FCC process which already has an excess of heat in most cases.

The processing of increasingly heavier feeds and the tendency of such feeds to elevate coke production is the source of excess heat and makes the control of regenerator temperatures difficult. Optimization of feedstock conversion is ordinarily thought to require essentially complete removal of coke from the catalyst. This essentially-complete removal of coke from catalyst is often referred to as complete regeneration. Complete regeneration produces a catalyst having less than 0.1 and preferably less than 0.05 weight percent coke. Complete regeneration maximizes heat generation by the thorough combustion of coke. In order to obtain complete regeneration, oxygen in excess of the stoichiometric amount necessary for the combustion of coke to carbon oxides is charged to the regenerator. Excess oxygen in the regeneration zone will also react with carbon monoxide produced by the combustion of coke, thereby yielding a further evolution of heat. The increase in coke on spent catalyst results in a larger amount of coke being burned in the regenerator per pound of catalyst circulated. Heat is removed from the regenerator in conventional FCC units in the flue gas, and principally in the hot regenerated catalyst stream. An increase in the level of coke on spent catalyst will increase the temperature difference between the reactor and the regenerator, and the regenerated catalyst temperature overall. A reduction in the amount of catalyst circulated is, therefore, necessary in order to maintain the same reactor temperature. However, as discussed above the lower catalyst circulation rate required by the higher temperature difference between the reactor and the regenerator will lower hydrocarbon conversion, making it necessary to operate with a higher reactor temperature in order to maintain conversion at the desired level. This will cause a change in yield structure which may or may not be desirable, depending on what products are required from the process. Also, there are limitations to the temperatures that can be tolerated by FCC catalyst without having a substantial detrimental effect on catalyst activity. Generally, with commonly available modern FCC catalyst, temperatures of regenerated catalyst are usually maintained below 760° C. (1400° F.), since loss of activity would be very severe at about 760°–790° C. (1400°–1450° F.). On the other hand, regenerator temperatures must be maintained above about 590° C. (1095° F.) to achieve acceptable coke combustion kinetics.

FCC units now commonly employ catalyst coolers to remove the heat associated with the regeneration of catalyst containing high coke levels. A particularly preferred type of catalyst cooler is located externally to the regenerator vessel. Cooler arrangements such as that shown in U.S. Pat. No. 4,374,750 withdraw hot catalyst from one section of the regenerator vessel and return cooled catalyst to the same or another section of the regenerator vessel. It is also been shown, as in U.S. Pat. No. 4,396,531, to use a catalyst cooler to remove catalyst from the regenerator vessel and transfer cooled catalyst to a reactor vessel. U.S. Pat. No. 4,757,039 shows a catalyst and cooler arrangement having a dual mode of operation wherein catalyst is transported downwardly through the cooler for discharge into a combustion zone or recirculated back through the cooler for mixing in the dense bed of a disengaging vessel.

There is a need for a catalyst cooler arrangement that will control temperature in the regenerator and facilitates independent control of reactor temperatures. Such a system is needed to adjust heat removal such that overall regeneration temperatures are regulated to effect coke combustion without catalyst damage and reaction temperatures are adjusted for varying selectivity requirements of the products.

Accordingly, it is an object of this invention to provide an FCC process that decouples thermal control of regeneration temperature from the control of the temperature entering the reactor riser.

It is a further object of this invention to provide an FCC process that independently regulates the temperature of the catalyst within the regenerator and the temperature of the catalyst transported to the reactor riser.

It is a yet further object of this invention to provide an FCC method and apparatus that permits independent control of the temperature to the reactor riser and in the regeneration vessel with a single catalyst cooling zone.

SUMMARY OF THE INVENTION

This invention provides the advantage of catalyst to oil ratio adjustment independent of regenerator temperature control. By the cooling of a reactor bound catalyst stream from the regeneration zone and the cooling of a circulating regeneration zone catalyst stream in a manner that allows differing amounts of heat removal from the two streams, reactor temperatures are not constrained by regenerator temperatures. This flexible control of catalyst temperatures on the reaction side and on the regeneration side of the process permits very cool catalyst to enter the reactor without reducing regenerator burn kinetics below acceptable levels. Balancing the heat removal between the regenerator vessel and the reactor riser simultaneously maintains regeneration temperature and allows the most favorable ratios of catalyst to oil mixture in the reactor riser. Moreover, the process arrangement of this invention permits variations in temperature and catalyst circulation on both the reaction side and the regeneration side of the process to provide the most favorable conditions for both feed contacting and coke combustion.

The process arrangement provides at least two zones of cooling on the regeneration side of the process. One zone of cooling supplies catalyst to the reaction side of the process while the other zone of cooling provides catalyst for circulation on the regeneration side of the process. It is contemplated that the cooling zones will employ indirect heat exchange elements in arrangements similar to the catalyst coolers now in operation on FCC units. In one arrangement the cooling zones may be isolated from each other. Each zone may withdraw catalyst from a different region of the regeneration vessel. In another form of the invention the cooling zones may be integrated. The integration may include withdrawal of catalyst from the same location in the regeneration vessel and/or the use of common heat exchange elements.

A principle advantage of the decoupled regeneration zone and reaction zone temperatures is the ability to increase the solids to feed ratio in the reaction zone. A greater solids ratio improves catalyst and feed contacting. Moreover a large quantity of cooled catalyst more evenly and quickly distributes the heat to the feed relative to lesser amounts of hotter catalyst. In addition, the larger amount of catalyst transfers heat to the catalyst at a reduced temperature differential between the catalyst and the feed. Together both of these effects lead to more uniform feed and catalyst contacting and a resulting decrease in dry gas production.

Accordingly, in one embodiment this invention is a process for the catalytic cracking of hydrocarbons. The process passes a first stream of catalyst comprising cooled regenerator catalyst from a regeneration zone to a reaction zone. The regenerated catalyst from the first stream contacts a feedstream containing hydrocarbons in the reaction zone to crack hydrocarbons and deposit coke on the catalyst and produce spent catalyst and hydrocarbon products. The process separates a hydrocarbon product stream from the spent catalyst and passes the spent catalyst to the regeneration zone. A second stream of catalyst comprising cooled regenerated catalyst and the spent catalyst from the reaction zone contacts an oxygen-containing stream in the regeneration zone to combust coke from the catalyst particles and produce a third stream of catalyst comprising regenerated catalyst. At least a first portion of the catalyst from the third stream is cooled to produce cooled regenerated catalyst. A first portion of the cooled regenerated catalyst passes into contact with the spent catalyst as the second stream of catalyst and a portion of the cooled regenerated catalyst passes to the reaction zone as the first stream of catalyst.

In another embodiment this invention is process for the fluidized catalytic cracking of hydrocarbons. The process passes a first cooled stream of catalyst from a catalyst cooler to a reaction zone and contacts the first cooled stream of catalyst with a hydrocarbon containing feedstream. Contact of the feedstream in the reaction zone cracks hydrocarbons and deposits coke on the catalyst to produce spent catalyst and hydrocarbon products. Hydrocarbon products are separated from the spent catalyst and recovered. Hydrocarbons are stripped from the spent catalyst and the spent catalyst is passed to a combustion zone. Contact of the spent catalyst in the combustion zone with an oxygen containing gas and a second stream of cooled catalyst combusts coke from the catalyst and produces hot regenerated catalyst. The process cools a first portion of the hot regenerated catalyst in a single cooling zone to produce cooled regenerated catalyst. A first portion of the cooled regenerated catalyst is withdrawn from a first section of the cooling zone at a first elevation and passed to the reaction zone as the first cooled stream of catalyst. The process withdraws a second portion of the cooled regenerated catalyst from a second section of the cooling zone at a second elevation and passing the second portion to the combustion zone as the second stream of cooled catalyst. The first section is at a different elevation than the second section and in this manner retains independent temperature control.

In an apparatus embodiment, this invention comprises a reactor and regenerator arrangement. The apparatus includes a riser having an inlet and an outlet end. The outlet end of the riser communicates with a separator for separating catalyst from hydrocarbon vapors. A stripper receives catalyst from the separator and removes additional hydrocarbon vapors. A regeneration vessel receives stripped catalyst from the stripping vessel via a reactor conduit. At least one cooling vessel receives catalyst from the regeneration vessel and has a heat exchange surface for removing heat from the catalyst therein. A regenerated catalyst conduit communicates catalyst from the cooling vessel to the reactor riser. A catalyst recirculation conduit circulates catalyst from the cooling vessel to the regeneration vessel.

Additional objects, embodiments, and details of this invention will become apparent from the following detailed description.

DETAILED DESCRIPTION OF THE INVENTION

This invention is more fully explained in the context of an FCC process. The drawings illustrate typical FCC process flows arranged in accordance with this invention. The description of this invention in the context of the depicted process arrangements is not meant to limit it to the details disclosed therein.

Figure 1:
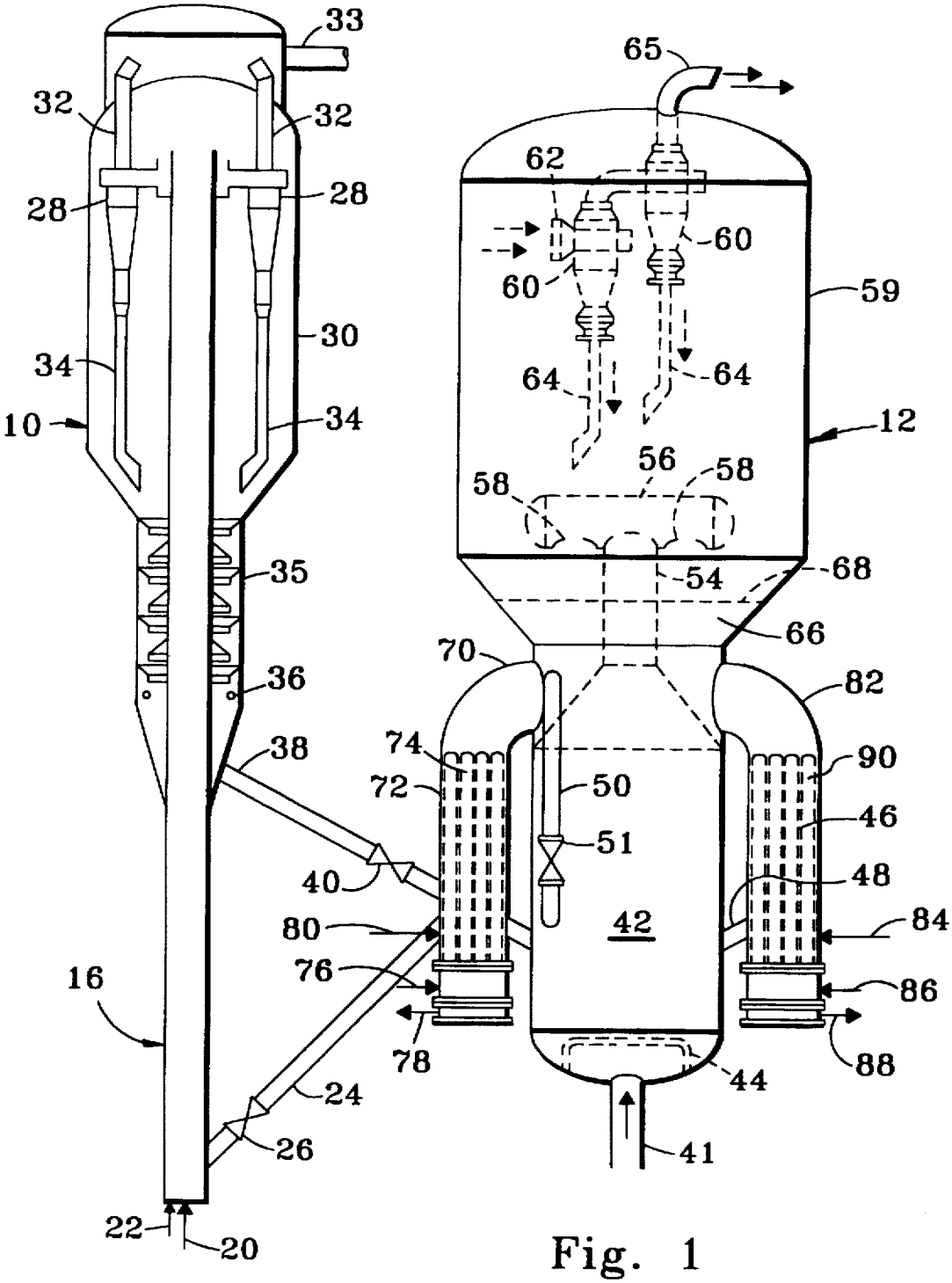
FIG. 1 is an elevation view showing a schematic cross section of an FCC reactor and regenerator designed in accordance with this invention.

The FCC arrangement shown in FIG. 1 consists of a reactor 10, a regenerator 12, an elongate riser reaction zone 16, and cooling zones 46 and 72. The arrangement circulates catalyst and contacts feed in the manner hereinafter described.

The catalyst that enters the riser can include any of the well-known catalysts that are used in the art of fluidized catalytic cracking. These compositions include amorphous-clay type catalysts which have, for the most part, been replaced by high activity, crystalline alumina, silica or zeolite containing catalysts. Zeolite catalysts are preferred over amorphous-type catalysts because of their higher intrinsic activity and their higher resistance to the deactivating effects of high temperature steam exposure and exposure to the metals contained in most feedstocks. Zeolites are the most commonly used crystalline alumina silicates and are usually dispersed in a porous inorganic carrier material such as silica, alumina, or zirconium. These catalyst compositions may have a zeolite content of 30% or more.

FCC feedstocks, suitable for processing by the method of this invention, include conventional FCC feeds and higher boiling or residual feeds. The most common of the conventional feeds is a vacuum gas oil which is typically a hydrocarbon material having a boiling range of from 650°–1025° F. and is prepared by vacuum fractionation of atmospheric residue. These fractions are generally low in coke precursors and the heavy metals which can deactivate the catalyst. Heavy or residual feeds, i.e., boiling above 930° F. and which have a high metals content, are finding increased usage in FCC units. These residual feeds are characterized by a higher degree of coke deposition on the catalyst when cracked. Both the metals and coke serve to deactivate the catalyst by blocking active sites on the catalysts. Coke can be removed to a desired degree by regeneration and its deactivating effects can thus be overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst makeup required to maintain constant activity. The contaminant metals include nickel, iron, and vanadium. In general, these metals affect selectivity in the direction of less gasoline and more coke and dry gas. Due to these deleterious effects, the use of metal management procedures within or before the reaction zone are anticipated in processing heavy feeds by this invention. Metals passivation can also be achieved to some extent by the use of an appropriate lift gas in the upstream portion of the riser.

Looking then at the reactor side of FIG. 1, FCC feed from a conduit 20 is mixed with an additional fluidizing medium from line 22, in this case steam, and charged to the lower end of riser 16. A combined stream of feed and fluidizing medium are contacted with catalyst that enters the riser through regenerated catalyst conduit 24 in an amount regulated by a control valve 26. Although the drawing shows contact of the feed and catalyst at the initial point of catalyst entry, feed may also be added at a more downstream riser location and the catalyst initially transported up the riser by a suitable lift gas. Prior to contact with the catalyst, the feed will ordinarily have a temperature in the range of from 300° to 600° F.

The catalyst that contacts the feed will ordinarily have a lower temperature than the average catalyst temperature in the regenerator. The amount of lower temperature regenerator catalyst that contacts the feed will vary depending on the cooling of the regenerated catalyst and the desired catalyst to oil ratio in riser 16. Generally, the ratio of catalyst to feed will be in range of from 5 to 25, preferably in a ratio of from 10 to 25, and more preferably in ratio of from 10 to 15.

Higher ratios of catalyst to feed promote more rapid vaporization of the feed and increases the catalyst surface area in contact with the feed to make vaporization more uniform. Both of theses effects promote a more uniform distribution of feed through the riser. The greater quantity of catalyst reduces the required heat per pound of catalyst for raising the temperature of the entering feed so that a high feed temperature is achieved with less temperature differential between the feed and the catalyst. Reduction of the temperature differential between catalyst and feed prevents shattering of the dispersed oil droplets and replaces violent mixing with the more complete contacting offered by the elevated volume of catalyst.

The temperature of the regenerated catalyst that contacts the feed will usually be in a range of from 900° to 1400° F. and more preferably in a range of from 950° to 1200° F. with regenerated catalyst temperatures below 1150° F. being particularly preferred. As the feed and catalyst mixture travels up the riser, the feed components are cracked and the mixture achieves a constant temperature. This temperature will usually be at least 900° F.

Other conditions within the riser generally include a catalyst density of less than 30 lb/ft$^3$, average gas velocities of at least 5 ft/sec. and an average feed contact time of less than 10 seconds. In the operation of this invention, the increased circulation of catalyst will tend to raise average catalyst densities in the riser. Thus, in preferred operations the catalyst density in the riser ranges from 2 to 30 lb/ft$^3$ and the average feed contact time is from 0.5 to 10 seconds.

The catalyst and reacted feed vapors are discharged from the end of riser 16 and separated into a product vapor stream and a quantity of catalyst particles covered with substantial amounts of coke and generally referred to as spent catalyst. One or more cyclones 28 remove catalyst particles from the product vapor stream to reduce particle concentrations to very low levels. Cyclone separators are not a necessary part of this invention. This invention can use any arrangement of separators to remove spent catalyst from the product stream.

FIG. 1 shows a specialized arrangement for the separation of the product vapors from the spent catalyst. This arrangement shows cyclones 28 in a vented riser arrangement located with a reactor vessel 30. The vented riser arrangement is described in U.S. Pat. No. 4,495,063, the contents of which are hereby incorporated by reference. Vessel 30 serves as an initial zone of catalyst and product disengagement. Another useful arrangement for separating products from catalyst on the reactor side of the process is a swirl arm arrangement as described in U.S. Pat. No. 4,397,738, the contents of which are hereby incorporated by reference. Product vapors exit the top of reactor vessel 30 through the cyclone conduits 32 and product vapor conduit 33. Cyclones 28 return separated catalyst to the reactor vessel through dip leg conduits 34.

Product vapors are transferred to a separation zone for the removal of light gases and heavy hydrocarbons from the products. Product vapors from product conduit 33 are transferred to a main column (not shown) that contains a series of trays for separating heavy components such as slurry oil and heavy cycle oil from the product vapor stream. Lower molecular weight hydrocarbons are recovered from upper zones of the main column and transferred to additional separation facilities or gas concentration facilities.

Catalyst separated from the product feed vapors drops to the bottom of reactor vessel 30 into a stripping zone of a stripping vessel 35. The stripping vessel removes adsorbed hydrocarbons from the surface of the catalyst by countercurrent contact with steam. Steam enters the stripping vessel 35 through a distribution ring 36. Spent catalyst stripped of hydrocarbon vapors leave the bottom of stripping vessel 35 through a reactor conduit 38 at a rate regulated by a control valve 40.

Turning next to the regenerator side of the process, as shown in FIG. 1, regenerator 12 removes coke deposits from catalyst. Catalyst from line 38 enters a combustion zone in the form of a lower combustor 42 of regenerator 12. Combustor 42 is a fast fluidized zone through which an oxygen containing stream transports catalyst while initiating coke combustion. The oxygen containing stream, usually air, enters combustor 42 via line 41 that supplies the oxygen-containing gas to a distributor 44 which distributes the gas over the transverse cross-section of combustor 42. The upward flow of gas through combustor 42 creates the fast fluidized conditions by transporting the catalyst upwardly at a velocity of between 8 to 25 ft/sec and at a density in a range of from 4 to 34 lbs/ft$^3$. Typical temperatures in the combustion zone range from 1250° to 1400° F. Temperatures within the combustion zone can be raised by initiating or increasing circulation of hot regenerated catalyst into the combustion zone via a recirculation conduit 50 at a rate controlled by a valve 51. Passing cooled regenerated catalyst into the combustor from a catalyst cooler through a cooler line 48 lowers temperatures within the combustion zone.

The catalyst and gas mixture passes from the combustion zone 42 into a combustion riser 54. The reduction in flowing diameter from combustion zone 42 to riser 54 accelerates the catalyst. Typical catalyst velocities in the combustion riser range from 20 to 70 ft/sec. and catalyst traveling up the riser usually has a density in a range of from 2 to 4 lbs/ft$^3$.

Residence time through the combustor and riser will usually provide sufficient reaction time to completely combust coke and fully regenerate the catalyst i.e., removal of coke to less than 0.1 wt. %. In addition, catalyst and gas residence time through the combustor and riser can also be set to obtain a complete combustion of CO to $CO_2$. This invention permits adjustment of the catalyst circulation rate and coke on catalyst to obtain complete catalyst regeneration, and complete CO combustion if desired, in the combustor and riser. Increasing the catalyst circulation rate on the regenerator side of the process will lower the amount of coke entering the combustor by the amount necessary to obtain complete catalyst regeneration and CO combustion.

The top of riser 54 contains a tee arm disengager arrangement 56 located in a disengaging vessel 59. The tee arm disengager discharges catalyst from openings 58. Other types of disengagers may be used in the regenerator arrangement. For example, a swirl arm disengager as previously described for the end of the riser may be suitable for the regenerator as well.

After an initial disengagement of the catalyst gas and entrained catalyst pass overhead to cyclone separators 60. Again, in an arrangement similar to that described in conjunction with the reactor vessel, cyclone arrangement 60 receives gas and catalyst through inlet 62 and directs separated gas overhead for removal from the regenerator via line 65 for treatment or further processing. Such processing can include removing of ultra fine particulate material and the recovery of sensible heat.

Catalyst removed by cyclone separators 60 drops the bottom of diplegs 64 to the bottom of disengaging vessel 59. Catalyst from disengaging vessel 59 collects in a collection zone 66 of regenerator 12. Additional oxygen-containing gas is compressed and transferred into zone 66 to maintain the disengaging zone catalyst in a fluidized state. Dispersal of the air maintains a dense catalyst bed in zone 66 and establishes an upper bed surface 68. For the purpose of this invention, a dense catalyst bed is defined as having a density of at least 10 lb/ft$^3$ and more typically a density in a range of from 30 to 40 lb/ft$^3$. The elevation of bed surface 66 is determined by the amount of air that enters zone 66 and the quantity of catalyst maintained in the zone 66. Small amounts of hot catalyst are entrained in air and combustion gases rising out of zone 66 are carried above bed surface 68. The small amounts of entrained catalyst are separated by the cyclones 60 and returned to disengaging zone 66.

A portion of the hot regenerated catalyst from disengaging zone 66 is cooled in a catalyst cooling zone. A portion of the hot regenerated catalyst passes through a nozzle 70 and into a catalyst cooling zone 72 in the form of a heat exchange zone or catalyst cooler. The cooling zone contains bayonet-type heat exchange tubes 74. The operation of such a heat exchanger is fully described in U.S. Pat. No. 4,757,038 the contents of which are hereby incorporated by reference. The catalyst indirectly contacts a heat exchange fluid that enters the bayonet tubes through a line 76 and leaves the bayonet tubes through a line 78. This indirect contact lowers the temperature of the catalyst in cooling zone 72. Heat removal is controlled to reduce the catalyst temperature to the ranges previously described for conduit 24. Cooling fluid circulation and catalyst circulation may be used to transport to control heat removal. An additional means of controlling catalyst transport as well as heat transfer in the catalyst cooler is the addition of fluidizing gas via a line 80. Fluidizing gas normally comprises an oxygen containing gas such as air and will further serve to fluidize catalyst in disengaging zone 66. Any combination of cooling fluid transfer rates, catalyst circulation rates and fluidizing gas addition may be used to control heat removal within catalyst cooling zone 72 and obtain the desired temperature for catalyst withdrawn by regenerated catalyst conduit 24.

Another portion of the hot regenerated catalyst from disengaging zone 66 is withdrawn by a nozzle 82 and passes into catalyst cooling zone 46. Catalyst cooling zone 46 can be operated in a manner similar to that described for catalyst cooling zone 72 with control of heat removal by the addition of fluidizing gas through a nozzle 84 and the circulation of cooling fluid into and out of the cooler through lines 86 and 88 respectively. The transfer of catalyst through cooling zone 46 may be also controlled by the addition of fluidizing gas which can serve to restrict or increase the flow of catalyst through conduit 48. Alternately, conduit 48 may contain a control valve (not shown) to directly control the transfer of catalyst through cooling zone 46 thereby employing the addition of fluidizing exclusively in the control of heat transfer over the heat exchange tubes 90 that are contained in catalyst cooling zone 46.

With the configuration of catalyst coolers shown in FIG. 1, the recirculation conduit 50 circulates hot regenerated catalyst to the combustion zone 42 to permit a constant heat removal duty for catalyst cooling zone 46. Catalyst recirculation conduit 50 may be omitted and the total circulation of catalyst from disengaging zone 66 may pass through catalyst cooling zone 46. In such cases, cooling zone 46 may be operated to provide as little or as much heat removal as necessary to maintain the desired temperature in combustion zone 42.

The description of the invention in the context of FIG. 1 with a combustor style regenerator is not meant to limit the application of this invention to such configurations. Those skilled in the art can apply the principles of this invention to other regenerator configurations. For example in a bed type regenerator, the catalyst may be circulated through two coolers with catalyst from one cooler circulated back to the reactor via a regenerator conduit and catalyst from another cooler lifted into the bed of the regenerator by an appropriate transport fluid such as air.

Figure 2:
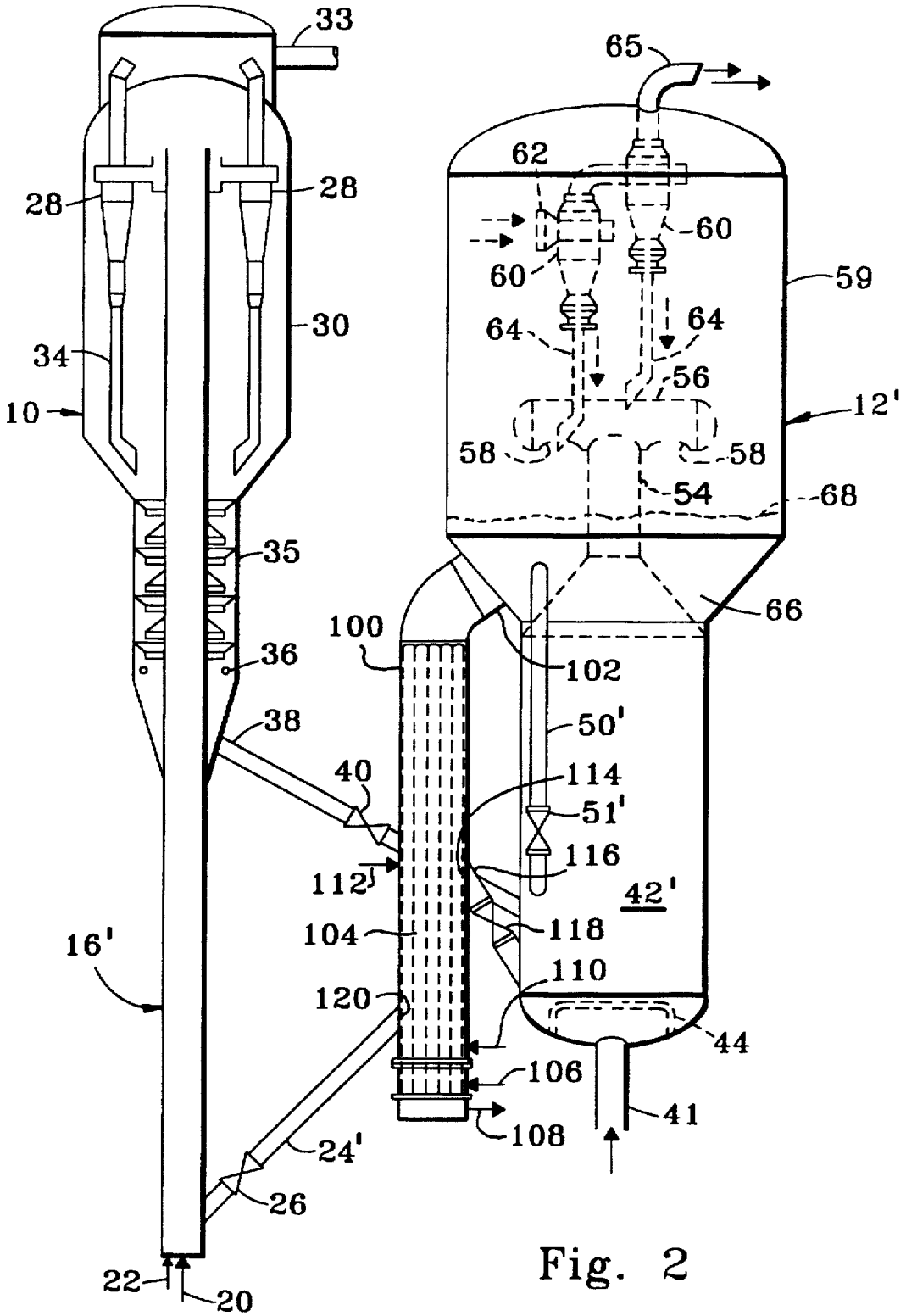
FIG. 2 is an modified elevation view showing an alternate arrangement for the cooling zone of the reactor and regenerator arrangement shown in FIG. 1.

It is also possible to independently control reactor and regenerator temperatures with a single cooler incorporated into a dense bed combustor or other style regenerator. FIG. 2 shows a reactor regenerator arrangement with a single catalyst cooler that supplies cooled catalyst to both the reactor and the regenerator sides of the process. The reactor and regenerator shown in FIG. 2 are, apart from the cooler arrangement, functionally the same as the reactor and regenerator shown in FIG. 1. The reference numerals in FIGS. 2 and 3 will be identical where they indicate structures that are the same in FIGS. 1, 2, and 3. Catalyst is withdrawn from the cooler at two different elevations to obtain the independent temperature control.

Regenerator 12' has a single catalyst cooler 100 that receives catalyst from a disengaging zone 66' through a nozzle 102. Catalyst cooler 100 operates to remove heat from the catalyst passing therethrough via contact with heat exchange tubes 104 in a manner previously described by the circulation of a cooling fluid into catalyst cooler 100 through nozzle 106 and out through a nozzle 108. Fluidizing gas is also added to cooler 100. In this case the fluidizing gas enters at the bottom of the cooler via line 110 and at a midpoint of the cooler via line 112. An outlet 114 located at a midpoint of the cooler withdraws catalyst for transfer to combustion zone 42' via a cooler standpipe 116 at a rate regulated by a control valve 118. Towards the bottom of the cooler an outlet 120 withdraws catalyst from below outlet 114 for transfer to the reactor riser 16' via a cooler conduit 24'.

Cooler 100 offers sufficient independent control of the temperature in the reaction zone and the regeneration zone to obtain the benefits of this invention. The flexibility of this cooler arrangement to provide independent control of the temperature in the reactor riser and the regeneration zone is apparent from a study of several design flow cases. The overriding control variable for the operation of the cooler in FIG. 2 is the temperature of the catalyst withdrawn through outlet 120. The cooler is operated firstly to control the temperature of the catalyst at the bottom of the cooler. In a first case, where no cooling is desired on the regeneration side of the process, the cooler may be operated with control valve 118 in a closed position and the addition of fluidizing gas through nozzles 112 and 110, and/or the circulation of cooling fluid through nozzles 106 and 108 may be controlled to obtain any desired degree of cooling and a wide range of temperature control for the catalyst that is transferred to the reaction zone.

In another case where the objectives are substantially opposite and cooling is desired principally on the regeneration side of the process, the cooler may be operated with a very high circulation rate through an upper section of the cooler such that a large volume of catalyst passes through the cooler via line 116, but at minimal temperature drop. Furthermore, the majority of the fluidizing gas may be passed into the cooler through line 112 with only a minimal amount of fluidizing gas entering through line 110. Adjustment of fluidizing gas delivery in this manner maximizes the amount of heat transfer that takes place in the upper section of the cooler where there is a high transport volume of catalyst and minimizes heat transfer across the tubes in the lower part of the cooler where a relatively constant catalyst temperature is maintained to minimize the reduction in temperature for the catalyst passing through line 24'. High catalyst circulation rates through the upper portion of the cooler can raise regenerator heat removal with minimum losses in catalyst temperature. In this manner the single cooler can provide sufficient regenerator cooling with only a minimal decrease in the temperature of catalyst transferred to the reactor.

It is also possible to operate the cooler with a relatively constant reactor temperature and heat removal duty. In this mode of operation the addition of line 50' and valve 51' to control a direct circulation of hot catalyst into the combustion zone further enhances the flexibility of the cooler operation. Line 50' and valve 51' add the further combustor temperature control flexibility by the direct addition of hot catalyst to offset any unwanted reduction in catalyst temperature occurring in the cooler such that the desired average catalyst mixed temperature is maintained in combustor 42'.

Figure 3:
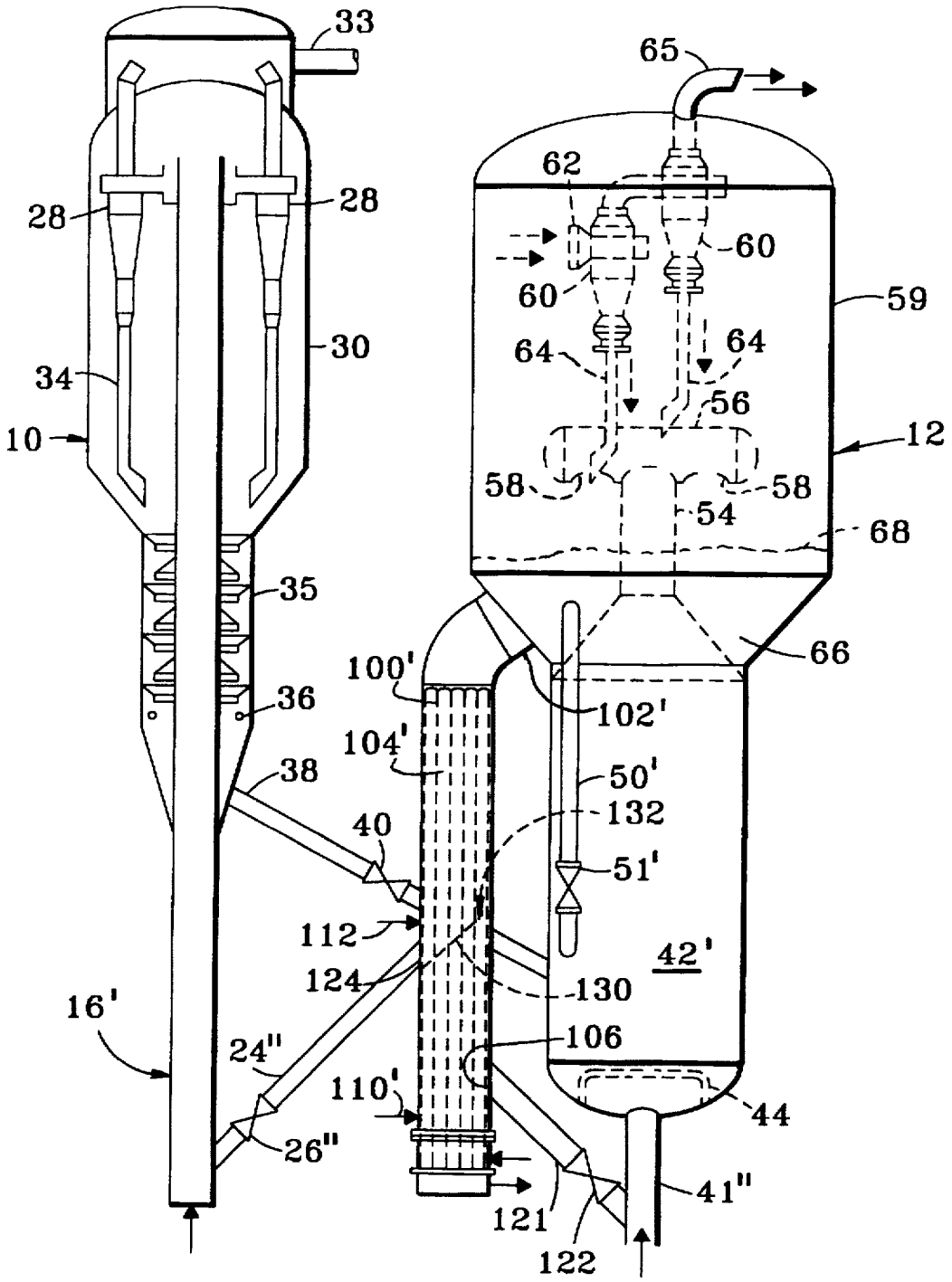
FIG. 3 is a further modification of the cooling arrangement shown in FIG. 2.

The arrangement of FIG. 2 offers the highest degree of control for catalyst circulated on the regeneration side of the process. A nearly identical arrangement for the process is shown in FIG. 3. FIG. 3 differs from FIG. 2 in that catalyst is withdrawn from a midpoint of a cooler 100' through an outlet 124 located at a midpoint of the cooler. Catalyst withdrawn from outlet 124 passes through a regenerated catalyst conduit 24" and through a control valve 26" to reactor riser 16'. Cooled catalyst to the combustor 42' follows a path out of catalyst cooler 100' through a nozzle 126 and standpipe 121 at a rate controlled by a control valve 122. Emptying of catalyst from standpipe 121 into the oxygen-containing gas stream of conduit 41" lifts cooled catalyst back into the combustor 42'. Cooler 100' can operate in a variety of modes to permit substantially independent control of temperatures on the reactor side of the process and the temperatures on the regenerator side of the process. In this arrangement the hottest catalyst from the catalyst cooler exits from a midpoint of the cooler and enters the reactor riser via conduit 24". Catalyst may be cooled to any degree desired for the reactor side without substantially affecting the regeneration side of the process. Any excessive temperature depression of the catalyst discharged into the regeneration zone from the lower section of the cooler may be offset by the circulation of hot catalyst into the combustion zone 42' via line 50'. When no cooling is desired on the regeneration side of the process, all of the recirculation of catalyst into the combustion zone from disengaging zone 66' may occur through conduit 50'. The desired amount of cooling on the regeneration side of the process is obtained by balancing the flow of catalyst through conduits 121 and 50' in any desired proportion.

Where a temperature reduction is principally desired on the regeneration side of the process, the volume of catalyst passing through cooler 100' may be increased to minimize the temperature drop of the catalyst from the inlet 102' of the cooler to the midpoint of the cooler. Increasing the volume of catalyst also raises the overall heat removal duty of the cooler so that a sufficient degree of cooling may be provided for the regenerator with minimal temperature drop for the reactor.

A further method for providing for high cooling on the regeneration side of the process without a simultaneously degree on the reactor side of the process can be achieved for the arrangement of FIG. 3 by the addition of a baffle 130 in cooler 100'. Baffle 130 is located along the heat exchange tubes just below outlet 124. Baffle 130 defines a reduced opening 132 for channeling fluidizing gas to one side of the catalyst cooler. Baffle 130 channels a majority of the fluidizing gas entering cooler 100' through nozzle 110' to one side as it passes through the upper portion of the cooler. Channeling of the fluid causes the fluidizing gas from the lower part of the cooler to by-pass most of the volume of the catalyst that passes through the upper section of the cooler. By-passing the fluidizing gas to one side of the catalyst cooler 100' in the upper section of the cooler minimizes the amount of heat transfer occurring therein and maximizes the temperature of the catalyst withdrawn through outlet 124. The ability to channel fluidizing gas is further increased by eliminating the tubes directly above the flow path defined between the channel and the cooler wall. The amount of heat transfer occurring in the lower section of the cooler may then be greatly increased by providing a high fluidizing gas input through inlet 110' without a subsequent raising of the heat transfer rate in the upper section of the cooler.

The arrangement shown in FIGS. 2 and 3 provide the benefits of substantially independent temperature control for the reactor and regeneration sides of the process without the addition of two separate catalyst coolers. All of the arrangements shown in FIG. 1 through 3 allow the regeneration zone to operate in the most effective manner while still providing a low temperature stream for the circulation of catalyst at high catalyst to oil ratios on the reactor side of the process.

What is claimed is:

1. A process for the fluidized catalytic cracking of hydrocarbons comprising:

a) passing a first stream of catalyst comprising cooled regenerated catalyst from a regeneration zone to a reaction zone b) contacting said regenerated catalyst from said first stream with a feedstream containing hydrocarbons in said reaction zone to crack hydrocarbons and deposit coke on said catalyst to produce spent catalyst and hydrocarbon products and separating a hydrocarbon product stream from said spent catalyst;

c) passing spent catalyst to said regeneration zone;

d) contacting a second stream of catalyst comprising cooled regenerated catalyst and said spent catalyst with an oxygen containing stream in said regeneration zone to combust coke from said spent catalyst and produce a third stream of catalyst comprising regenerated catalyst;

e) cooling at least a first portion of the catalyst from said third stream of regenerated catalyst in a single cooling zone to produce cooled regenerated catalyst;

f) withdrawing a first portion of said cooled regenerated catalyst from said single cooling zone from the bottom of a first section of said cooling zone located at a first elevation and passing said first portion of said cooled regenerated catalyst into contact with said spent catalyst as said second stream of catalyst;

g) adding a first fluidizing gas stream to the bottom of said first section;

h) withdrawing a second portion of said cooled regenerated catalyst from said single cooling zone from the bottom of a second section of said cooling zone located at a second elevation and passing said second portion of cooled regenerated catalyst directly to said reaction zone as said first stream of catalyst wherein said first section is at a different elevation than said second section to obtain independent temperature control of said first stream from said second stream; and i) adding a second fluidizing gas stream at the bottom of said second section.

2. The process of claim 1 wherein said second stream of catalyst comprising cooled regenerated catalyst and said spent catalyst are combined with at least a portion of the regenerated catalyst comprising said third stream catalyst.

3. The process of claim 1 wherein said second section of said cooling zone is located below said first section.

4. The process of claim 1 wherein said first section of said cooling zone is located below said second section.

5. A process for the fluidized catalytic cracking of hydrocarbons comprising:

a) passing a first cooled stream of catalyst from a catalyst cooler to a riser reaction zone;

b) contacting said first cooled stream of catalyst with a hydrocarbon containing feedstream in said riser reaction zone to crack hydrocarbons and deposit coke on said catalyst to produce spent catalyst and hydrocarbon products;

c) separating said spent catalyst from said hydrocarbon products and recovering said hydrocarbon products;

d) stripping hydrocarbons from said spent catalyst and passing said spent catalyst to a combustion zone;

e) contacting said spent catalyst in said combustion zone with an oxygen containing gas and a second stream of cooled catalyst to combust coke from said spent catalyst and produce hot regenerated catalyst;

f) cooling a first portion of said hot regenerated catalyst in a first section of said catalyst cooler, withdrawing said first portion of cooled catalyst from the bottom of said first section of said catalyst cooler at a first location and passing said first portion to said reaction zone as said first cooled stream of catalyst;

g) cooling a second portion of said hot regenerated catalyst in a second section of said catalyst cooler located below said first section, withdrawing said second portion of cooled catalyst from the bottom of said second section of said catalyst cooler at a second location and passing said second portion to said combustion zone as said second stream of cooled catalyst to obtain independent temperature control of said first portion temperature and said second portion temperature;

h) adding a first fluidizing gas stream to the bottom of said first section;

i) adding a second fluidizing gas stream to the bottom of said second section; and j) channeling fluidizing gas from said second section to by-pass a portion of the catalyst volume in said first section.

* * * * *